US005813610A

United States Patent [19]

Parr et al.

[11] Patent Number: 5,813,610

[45] Date of Patent: Sep. 29, 1998

[54] AIR DRYING SYSTEM WITH PAINT COATING APPARATUS

[75] Inventors: Aric J. Parr; William W. Wyant, both of Fort Wayne, Ind.

[73] Assignee: Carrier Corporation, Syracuse, N.Y.

[21] Appl. No.: 592,205

[22] Filed: Jan. 26, 1996

[51] Int. Cl.[6] ..... B02B 1/24

[52] U.S. Cl. ..... 239/135; 239/422; 239/418; 239/428; 239/434.5; 118/302

[58] Field of Search ..... 118/302; 239/135, 239/422, 418, 428, 434.5

[56] References Cited

U.S. PATENT DOCUMENTS

| | | | |
|---|---|---|---|
| 4,221,339 | 9/1980 | Yoshikawa | 239/704 |
| 4,918,939 | 4/1990 | Fresch et al. | 62/272 |
| 5,312,042 | 5/1994 | Larson | 239/135 |
| 5,428,963 | 7/1995 | Korycki et al. | 62/93 |
| 5,554,416 | 9/1996 | Scheufler et al. | 427/378 |

*Primary Examiner*—Katherine A. Bareford

[57] ABSTRACT

Paint coating apparatus exposes paint only to treated dried air. Air taken from a local source is preferably dried to a dew point temperature which removes any potentially damaging moisture that would otherwise be in the air. The thus dried air is provided to either the nozzle of a paint gun or, in the alternative, a paint dipping apparatus.

4 Claims, 2 Drawing Sheets

AIR DRYING SYSTEM WITH PAINT COATING APPARATUS

BACKGROUND OF THE INVENTION

This invention relates to pressurized paint coating apparatus and in particular to the atomization of the paint as it is dispersed from the paint coating apparatus.

Paint coating apparatus in the form of a paint gun will often include an atomization of the paint exiting from the nozzle of the paint gun. This atomization is often accomplished by the introduction of pressurized air into the flow of the paint exiting from the nozzle. The atomization of the paint by the pressurized air will provide a fine spray of paint for application to the ultimate object to be coated. The pressurized air is usually obtained from a local pressurized source of air.

It has been found that the pressurized air from the local air source will at times prematurely cure the atomized paint before it reaches the device to be coated. This has heretofore been remedied by using nitrogen gas as opposed to a local source of air. This use of nitrogen while effective in preventing the aforementioned premature curing of the paint is a rather costly substitute for the pressurized air.

OBJECTS OF THE INVENTION

It is an object of the invention to provide a paint coating apparatus with an appropriate atomization of the paint coating utilizing a local source of air in a manner which does not result in the premature curing of the atomized paint particles.

SUMMARY OF THE INVENTION

The above and other objects of the invention are accomplished by a paint coating apparatus that utilizes only pretreated air in the atomization of the paint. In particular, the air from the local pressurized source is first passed through an air dryer so as to remove any potentially damaging moisture in the air received from the local pressurized air source. The air is preferably dried by a twin tower desiccant air dryer.

In a preferred embodiment for a paint gun, the dried air is not only used to atomize the paint, it is also used to maintain the paint flow outlet area of the nozzle when there is no paint flowing out of the nozzle. In still another embodiment of the invention, the dried air is also used in a paint dipping apparatus as opposed to a paint gun so as to expose the paint coating on a dipped object only to dried air thereby eliminating any premature curing of the paint coating.

BRIEF DESCRIPTION OF THE DRAWINGS

Other objects and advantages of the present invention will be apparent from the following description in conjunction with the accompanying drawings, in which.

DESCRIPTION OF THE PREFERRED EMBODIMENT

Figure 1:
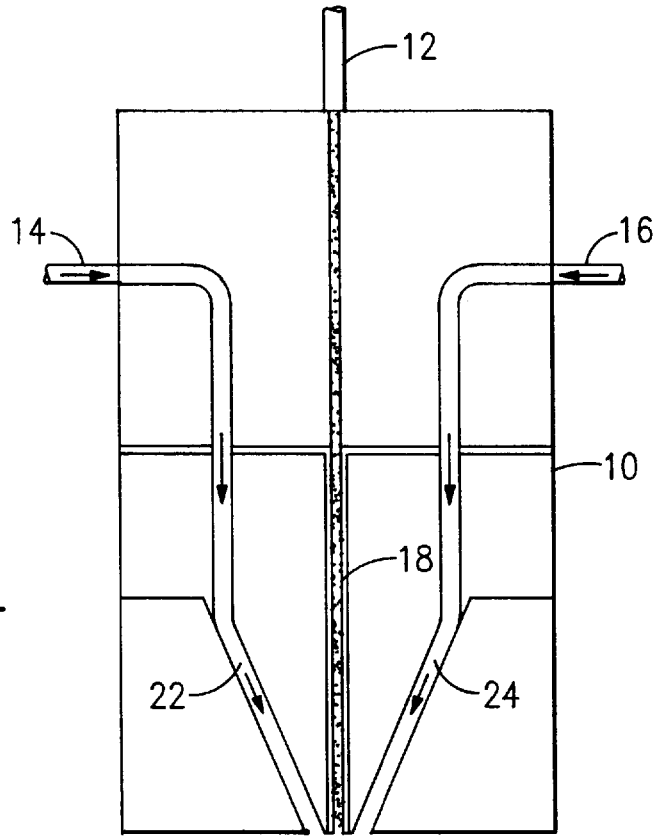
FIG. 1 illustrates the nozzle of a paint gun, which receives pressurized air and pressurized paint from apparatus upstream therefrom.

Referring to FIG. 1, a nozzle 10 for a paint spraying gun is generally illustrated in schematic form. The nozzle 10 receives pressurized paint in a liquid state from a feed line 12 as well as pressurized air from feed lines 14 and 16. The liquid paint flowing through the feed line 12 is introduced into a narrow channel 18 formed in the body of the nozzle 10. Paint exiting from the channel 18 at the outlet of the nozzle 10 is preferably atomized by pressurized air flowing at angled flow paths 22 and 24 defined within the body of the nozzle 10. The introduction of the pressurized air at the exiting point of the paint from the channel 18 produces an atomization effect of the paint so as to define a fine particle spray of paint from the nozzle 10. It is to be understood that the schematically depicted nozzle, as illustrated in FIG. 1, is well known in the art and commercially available from a number of paint gun manufacturers. For example, CONTROL COAT™ Dispensing Heads available from Nordson Corporation would have the appropriate inlet fitting 12, 14 and 16 and perform the internal air and paint flow paths generally depicted in FIG. 1 wherein the dark path is the paint flow path and the gray flow paths are the air paths.

Figure 2:
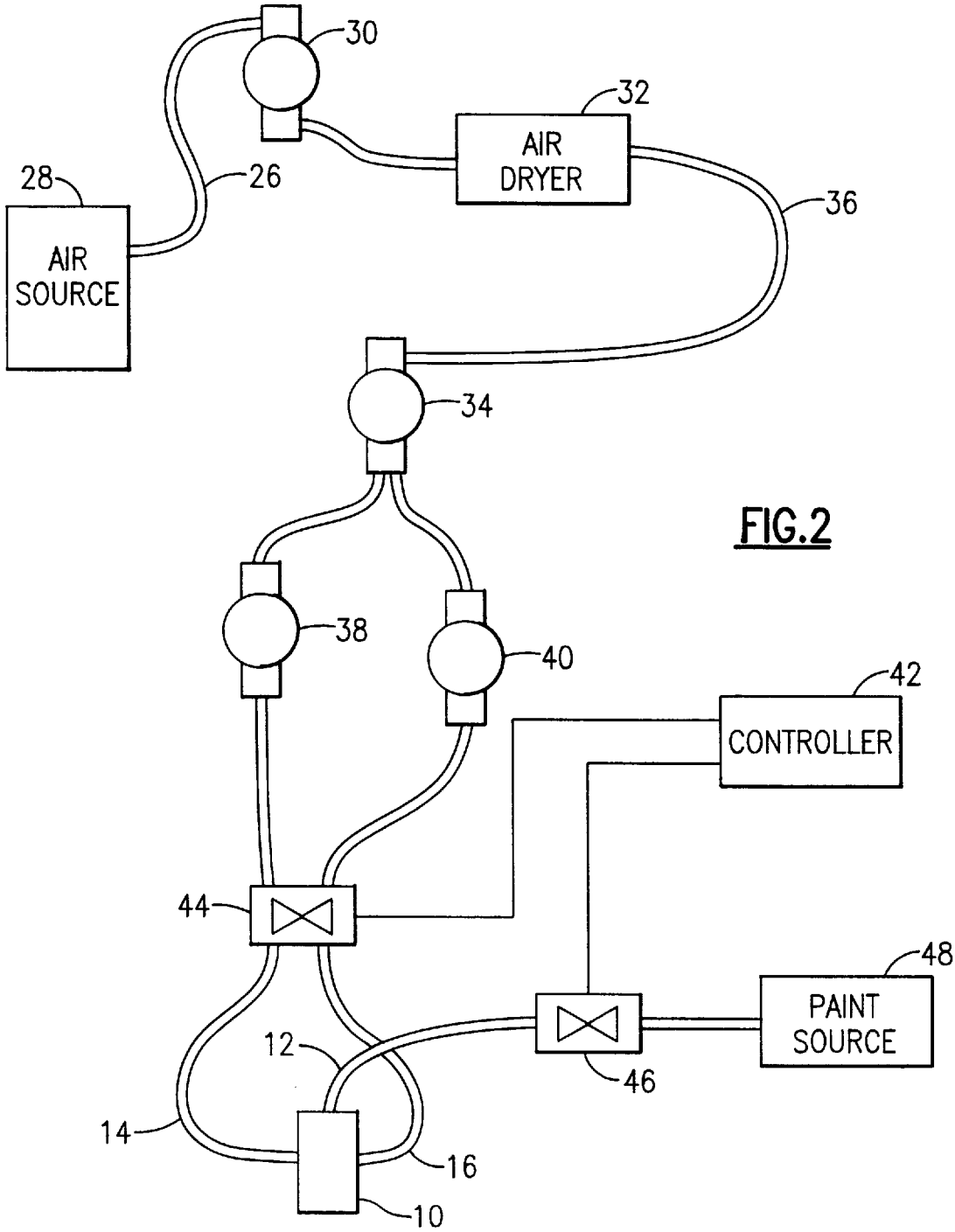
FIG. 2 illustrates the apparatus for providing the pressurized paint and air to the nozzle of the paint gun illustrated in FIG. 1.

Referring to FIG. 2, apparatus for supplying paint and treated air to the nozzle 10 is illustrated. The apparatus is seen to include an air line 26 connected to a local pressurized source of air 28. The pressurized air in the air line 26 at approximately ninety five pounds per square inch is first passed through a regulated valve 30, which defines the flow rate of the pressurized air to an air dryer 32 via an air line 31.

The air dryer 32 is preferably a self regenerating twin tower desiccant air dryer commercially available from a number of commercial companies. The air dryer preferably removes moisture from the incoming air from the air line 31 so as to produce exiting air having a dew point within the range of minus eighty to minus one hundred degrees Fahrenheit for air having a pressure at the exit of the air dryer in the range of eighty to one hundred pounds per square inch.

The dry air exiting from the dryer 32 is fed to a regulated valve 34 via an air line 36. The regulated valve 34 defines the rate of flow of the dry air to either a regulated valve 38 or a regulated valve 40. A controller 42 controls activation of the three way valve 44 so that dry air can flow to the inlet lines 16 and 18 from only valve 38 or only from valve 40, depending upon the signals from the controller 42 which will be explained hereinafter. The regulated valve 38 provides relatively dry air at a particular flow rate, through the three way valve 44, through the inlet lines 14 and 16associated with the nozzle of the paint gun when atomization of the paint is to occur, while the regulated valve 40 provides dry air at a different flow rate through the three way valve 44, through the inlet lines 16 and 18, when paint flow has stopped and no atomization will occur. In this manner, the dried air keeps channels 22 and 24 clear when paint is not flowing. This also keeps any paint at the exit of channel 18 from curing when paint is not flowing.

Referring to the inlet feed line 12 associated with the nozzle 10, it is seen that this feed line is connected to an upstream flow valve 46 which defines the flow of liquid paint to the feed line 12 from a pressurized paint source 48. The on or off status of the flow rate valve is defined by the controller 42. It is to be understood that when the controller turns the valve 46 off, it will also send a signal to the three way valve 44 causing the dry air from the valve 40 to be supplied to the nozzle 10 through the valve 44 at the flow rate dictated by regulated valve 40. The controller 42 will otherwise position the three way valve 44 to provide dry air from the valve 38 at the flow rate dictated by regulated valve 38 when the paint valve 46 is on.

Figure 3:
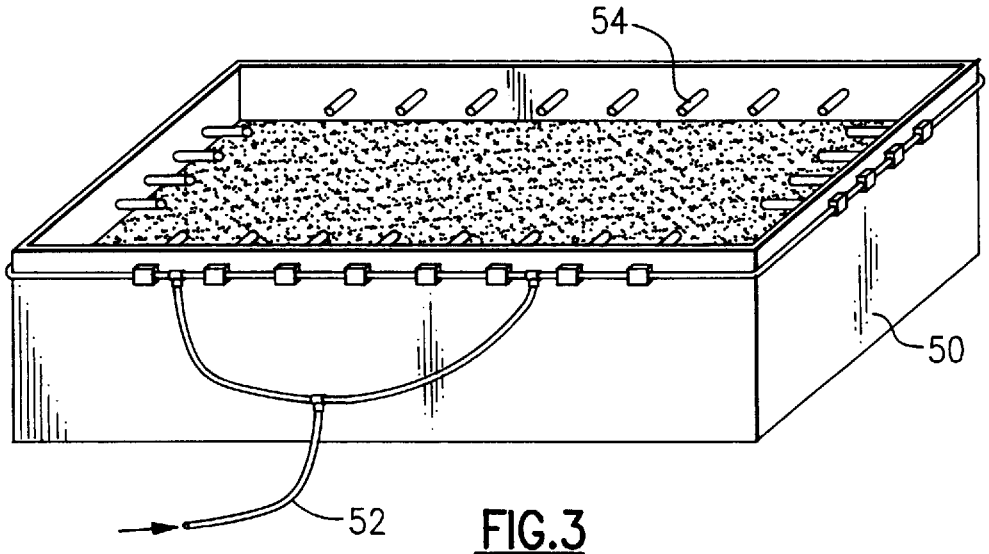
FIG. 3 illustrates a paint dipping apparatus, which utilizes the air provided by the apparatus of FIG. 2.

Referring now to FIG. 3, a paint dipping apparatus is illustrated as being an alternative downstream recipient of dried air from apparatus similar to that shown in FIG. 2. In particular, an air line 52 directly attaches to the regulated valve 34 of FIG. 2. The downstream valves 38 and 40 would not be necessary. The air line 52 circulates air around the perimeter of a paint bath apparatus 50. Air jets, such as 54, associated with the air line 52 define a dried air environment above a pool of paint 56 within the paint bath apparatus 50. Any object dipped into the paint pool within the paint bath apparatus 50 is exposed to the dried air flowing from the jets 54 when the coated object is removed from the dipping apparatus 50. In this manner, the dried air again prevents premature curing of the paint coating as it is being removed from the bath of paint in the paint dipping apparatus 50. It also prevents any curing of the paint within the paint bath by providing a blanket of dry air above this paint.

It is to be appreciated from the above that a particular embodiment of the invention has been described. Alterations, modifications and improvements thereto will readily occur to those skilled in the art. Accordingly, the foregoing description is by way of example only and the invention is to be limited only by the following claims and equivalents thereto.

What is claimed is:

1. A paint coating apparatus comprising:

a pressurized source of air;

moisture removal apparatus connected to said pressurized source of air, said moisture removal apparatus being operative to remove moisture from air received from said pressurized source of air so as to produce dry air leaving the moisture removal apparatus;

at least a first regulated valve downstream of said moisture removal apparatus for regulating the flow of the dry air from the moisture removal apparatus to a paint gun when paint is being supplied to the paint gun from a pressurized source of paint whereby the flow of dry air from said first regulated valve to the paint gun is at a particular flow rate when paint is being supplied to the paint gun, said paint gun being connected to the pressurized source of paint, said paint gun furthermore having a nozzle with an outlet end and a paint flow channel therein for defining at least one path of flowing liquid paint from the pressurized source of paint to the outlet end of the nozzle, said nozzle furthermore having at least one path for defining the flow of air received from at least the first regulated valve whereby the air at the outlet end of the nozzle intercepts the flowing liquid paint at the outlet end of the nozzle and thereby atomizes the liquid paint exiting from the paint flow channel at the outlet end of the nozzle; and a second regulated valve downstream of said moisture removal apparatus for delivering the dry air to the at least one path in the nozzle for defining the flow of air received from the at least first regulated valve at a flow rate different than the flow rate of delivered dry air from said first regulated valve downstream of said air moisture removal apparatus when paint is not being supplied to the paint gun from the pressurized source of paint.

2. The paint coating apparatus of claim 1 wherein said moisture removal apparatus produces dry air having a dew point of temperature in the range of minus eighty to minus one hundred degrees Fahrenheit.

3. The paint coating apparatus of claim 2 wherein said moisture removal apparatus is a twin tower desiccant air dryer.

4. The paint coating apparatus of claim 1 wherein said at least first regulated valve and said second regulated valve each have an outlet line associated therewith and wherein the paint coating apparatus further comprises:

a third valve connected to the outlet lines associated with said first and second regulated valves;

a controller for controlling said third valve so as to only permit air to flow through the at least one path in the nozzle from either the first regulated valve or the second regulated valve depending on whether paint is flowing through the paint flow channel.

* * * * *